US005660160A

United States Patent [19]

Prescott, Jr.

[11] Patent Number: 5,660,160

[45] Date of Patent: Aug. 26, 1997

[54] PNEUMATIC LAUNCHER

[75] Inventor: Melvin Eulan Prescott, Jr., Houston, Tex.

[73] Assignee: Melvin Eulan Prescott, Houston, Tex.

[21] Appl. No.: 476,073

[22] Filed: Jun. 7, 1995

[51] Int. Cl.[6] ..... F41B 11/00; F41B 11/32

[52] U.S. Cl. ..... 124/75; 124/70; 124/73

[58] Field of Search ..... 124/56, 70, 71, 124/73, 75, 81

[56] References Cited

U.S. PATENT DOCUMENTS

| | | | |
|---|---|---|---|
| 352,110 | 11/1886 | Bartlett | 124/75 |
| 1,266,764 | 5/1918 | Blair | 124/81 |
| 2,304,841 | 12/1942 | Mikkelsen | 124/70 X |
| 2,526,018 | 10/1950 | Foster et al. | 124/73 |
| 2,581,758 | 1/1952 | Galliano et al. | 124/75 |
| 2,703,944 | 3/1955 | Molyneux | 124/73 X |
| 3,400,703 | 9/1968 | Rhodes | 124/75 |
| 4,774,928 | 10/1988 | Kholin | 124/75 |
| 5,337,726 | 8/1994 | Wood | 124/75 X |

*Primary Examiner*—John A. Ricci

[57] ABSTRACT

This invention, the Pneumatic Launcher, is an improved, compressed inert gas powered, launching system for the airborne delivery of soft promotional items to persons in an arena or stadium environment. It is manually operable by one person. Receiving its power from a tank of compressed inert gas (usually nitrogen) fitted with a regulator and a three way manifold with two air lines and a relief valve, the unit has two hoses attached to its rear housing plate. One line fills the accumulator tank while the auxiliary line insures the pneumatic trigger always has gas pressure to complete the firing cycle. A ball valve of 1½ or larger releases the volume of gas from the accumulator tank quickly and completely, much more so than solenoid operated valves by virtue of the pneumatic air ram mechanism attached to the valve stem by a balanced cam type "T" shaped handle assembly. The released gas is channeled through a 180° curved tube into an expansion chamber that uses thin metal vanes to spin the gas as it approaches the barrel, thus allowing the lightest of objects to overcome air drag as best possible upon exiting the barrel. The loading and firing movements of the Pneumatic Launcher can be performed with one hand while the other, with the use of a shoulder strap, supports and balances the unit. As the handle on the sliding breach cover is moved forward, the barrel is tilted down for safety during loading, and as the handle is pulled back the barrel tilts up into normal ruing position. As the operator's hand moves to the firing button, the opening in the housing allows for a firm grip in a central balanced position on the unit so that final aiming can be quickly achieved. The Pneumatic Launcher can put a beverage insulator in a 12" circle at 50 feet or a soft ball in a 36" circle at 250 feet under normal circumstances.

10 Claims, 6 Drawing Sheets

PNEUMATIC LAUNCHER

TECHNICAL FIELD

This invention is an improved, compressed inert gas powered, launching system for the airborne delivery of soft promotional items to persons in an arena or stadium environment. Other common techniques for this type of distribution have proven slow, confusing and unsafe, so by using design experience from the fabrication of various types of special effects equipment and fine tuning the function to accommodate the types of promotional items often used, the invention was developed.

This invention relates to air mortar and gas cannon devices used in motion picture special effects. A search revealed no patents in these areas and no application of these machines to any uses in industry or other public uses. In motion pictures the gas cannon is used to release compressed natural gas or propane on cue where it is ignited to create a relatively safe and reliable fireball of visually dramatic proportions with no damage to sets or locations. Air mortars, while similar in design and operation, are operated at higher pressure with inert gasses moving light and safe debris (i.e. fuller's earth, vermiculite and cork fragments) from a cone shaped hopper attached to the end of the unit. In some instances a long barrel similarly attached focuses the air pressure at a "softened" target to remove it from a stuntperson's path during an action scene. As an example, the focused air pressure is used to blow balsa doors and "candy-glass" windows before a stuntperson contacts them, creating an illusion of their moving with greater speed and force. These machines are generally viewed to be a safe alternative to explosives when used under the strictly controlled conditions of a movie set and under direct supervision of a trained pyrotechnician, but would be unsafe and unreliable in industrial or public applications.

Most air mortar and gas cannons use a standard solenoid valve to expel the gas, and a sufficient volume of gas is not released quickly enough to propel an object with adequate speed or distance. A diaphragm type solenoid as used in some fast pitch softball machines and in industrial applications is more efficient, but upon testing proved inadequate in volume as well as bulky, heavy and expensive. In later design testing the use of 100% open ball valves proved successful in volume release when actuated by means of a pneumatic air ram attached to the handle. These units are not quickly reset and often have failures due to geometric misalignment between the linear actuator and the 90° turn on the valve handle creating stress on the valve stem. This invention uses a cam shaped plate on a "T" shaped handle frame to translate the linear thrust of the air ram into a smooth 90° circular turn that can be reset and reused quickly and efficiently. The addition of a slight pivot at the air ram mount and a grease-fitted hyme joint rod end on the air ram's rod make the mechanical open-close function of the valve acceptable in speed, volume and reliability. This system can fire and reset twice per second at 150# Pounds per Square Inch for one hour of continuous use with no signs of stress on valve parts, air ram or connecting hardware.

BACKGROUND ART

Commonly, in arena settings promotional items have been given away to the crowds by various means, mostly manual in nature. Often, crowding and rushing the person handing out the objects occurs and an even and fair distribution is difficult. In some instances, a rubber band powered sling shot unit has been utilized with some success, however, extremely lightweight objects such as beverage insulators have an unacceptable range and trajectory. Catapult-style devices such as those used to pitch baseballs at batting cage parks have been used to increase range to some degree, but at the cost of safety and accuracy due to the arching mechanism and arbitrary release of the object.

By utilizing the air cannon method of propulsion and directing the release of air down a length of tubing, an object's speed and direction can be controlled such that a short item of some mass may be delivered to an individual in a crowd setting safely and with accuracy. This invention, by spinning the gas as it picks up the object and moves it down the barrel, succeeds in delivering even the lightest and least aerodynamic objects at ranges from 100 to 500 feet without sacrificing accuracy or safety.

During design and testing of this invention, accommodations were made for the comfort, mobility and ease of operation for the operator, as this unit is designed to be hand held and operator supported in most instances. While a 60" barrel length is required to obtain the desired range and accuracy, and a 24" long accumulator tank is needed to supply the necessary gas volume at 150# Pounds per Square Inch, the overall length of the unit must be kept to a minimum for operational ease and safety. The invention's over-under configuration accommodates this design necessity, and the long 180° tubing bend allows the gas to flow without restriction as it approaches the expansion chamber and the directional vanes that spin the column of gas as it approaches the object to be delivered from the breach of the barrel. These design elements are unique to this invention and allow the mechanism to remain simple, lightweight and dependable.

BRIEF DISCLOSURE OF THE INVENTION

The preferred embodiment of the present invention has a base support unit or can be hand held and supported by a shoulder strap. Attached to this unit by means of two air lines is a tank of gas such as nitrogen fitted with the proper regulator and manifold. The structure of this invention is fabricated from three plasma cut steel bulkhead pieces welded to a 3½" steel tubing barrel and a tank assembly of 4½" steel tubing with a 1½" steel pipe manifold. The mechanical elements of this invention consist of a 1½" ball valve mounted between the tank assembly manifold and a 180° tubing bend 2" in diameter leading through an expansion chamber with directional vanes to the upper barrel. The valve is actuated by a double acting 1" bore air ram attached to a custom cam shaped "T" handle with a ball swivel red end at the valve end and a pivot mount at the center bulkhead. The item to be fired is loaded through a 4"×8" machined breach opening in the barrel that is covered by a slider cover of 4" machined aluminum tubing trapped by the fore and aft bulkhead plates cushioned at each end by a hollow rubber ring. The pneumatic actuation of this device occurs when a volume of compressed inert gas from the auxiliary inlet is channeled through a pneumatic trigger valve to the air ram, forcing the ball valve to open, thereby releasing the volume of gas stored in the accumulator tank through the 180° curved tube, the expansion chamber and the barrel. The air ram then returns to the closed position upon release of the pneumatic trigger valve button, thereby closing the ball valve and sealing the accumulator tank so that the cycle of the device is completed as the tank refills to working pressure through the main air line inlet.

The manual load of this invention is achieved by pushing the rod handle of the slider tube forward against the fore cushion until the breach is open to accept the item to be launched, then closed tightly by pulling the slider to the rear against the rear cushion. The same hand of the operator is then free to operate the pneumatic firing button. During the loading procedure, the forward push of the slider handle tilts the barrel of the device in a downward safety position for loading, and pulling back on the slider handle tilts the barrel up into firing position. The firing button is mounted on the central bulkhead of the unit so that maximum balance and control over the unit is achieved in the firing position. During testing, a normal loading and firing cycle could be completed safely and comfortably in three seconds, allowing plenty of time for the accumulator tank to refill from the nitrogen tank at 150# Pounds per Square Inch.

The object of this invention is to deliver with speed and accuracy an assortment of soft promotional objects (including beverage insulators, T-shirts, soft balls and stuffed figures) to a large group of persons in an arena or stadium setting.

An object of this invention is to maintain a safe and comfortable distance between the operator and the audience during the promotion or event while allowing interaction on an individual or mass basis at operator discretion.

Another object of this invention is to provide maximum mobility and ease of handling in a durable and reliable piece of equipment.

An additional object of this invention is to provide a visually striking and intriguing focal point for the promotion or event.

DRAWING FIGURES

DESCRIPTION OF FIGS. 1 THRU 8

Figure 1:
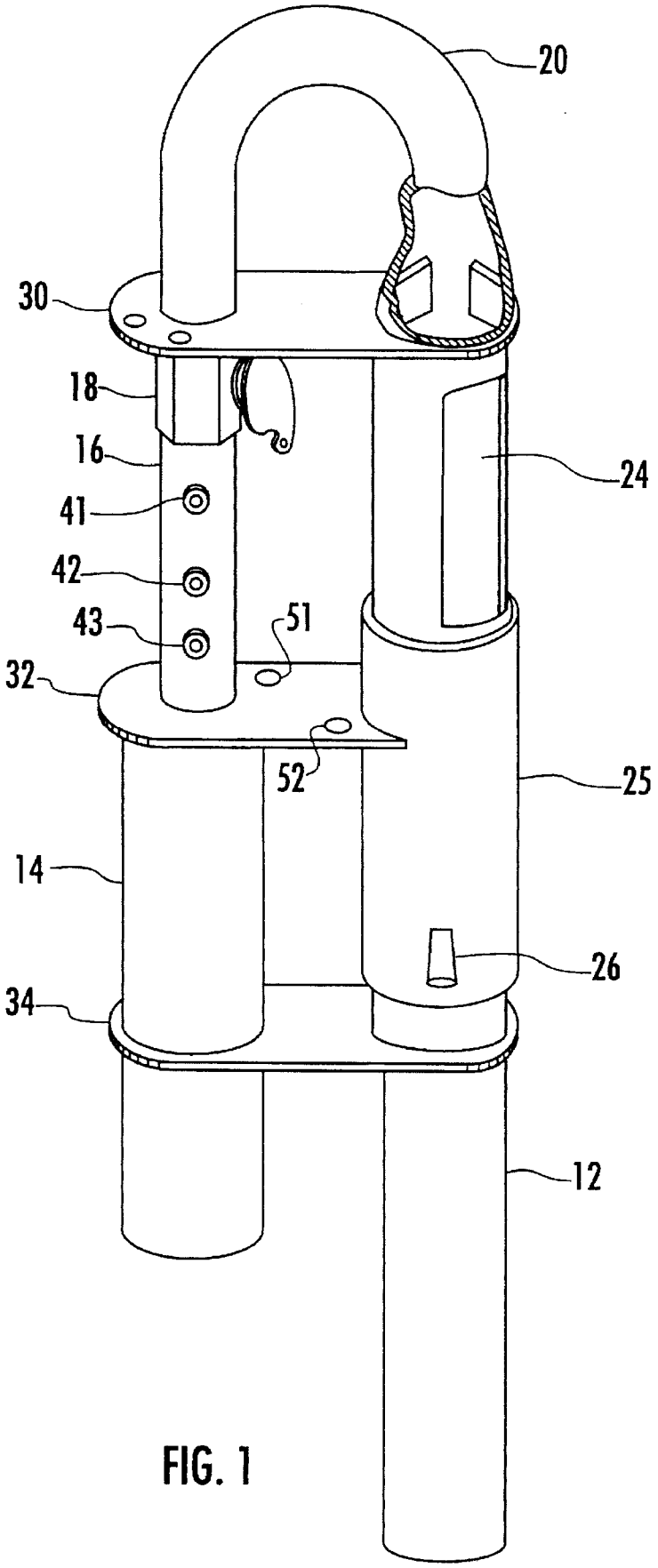
FIG. 1 shows in left view perspective the structural form of the invention without any mechanical elements included.
Figure 2:
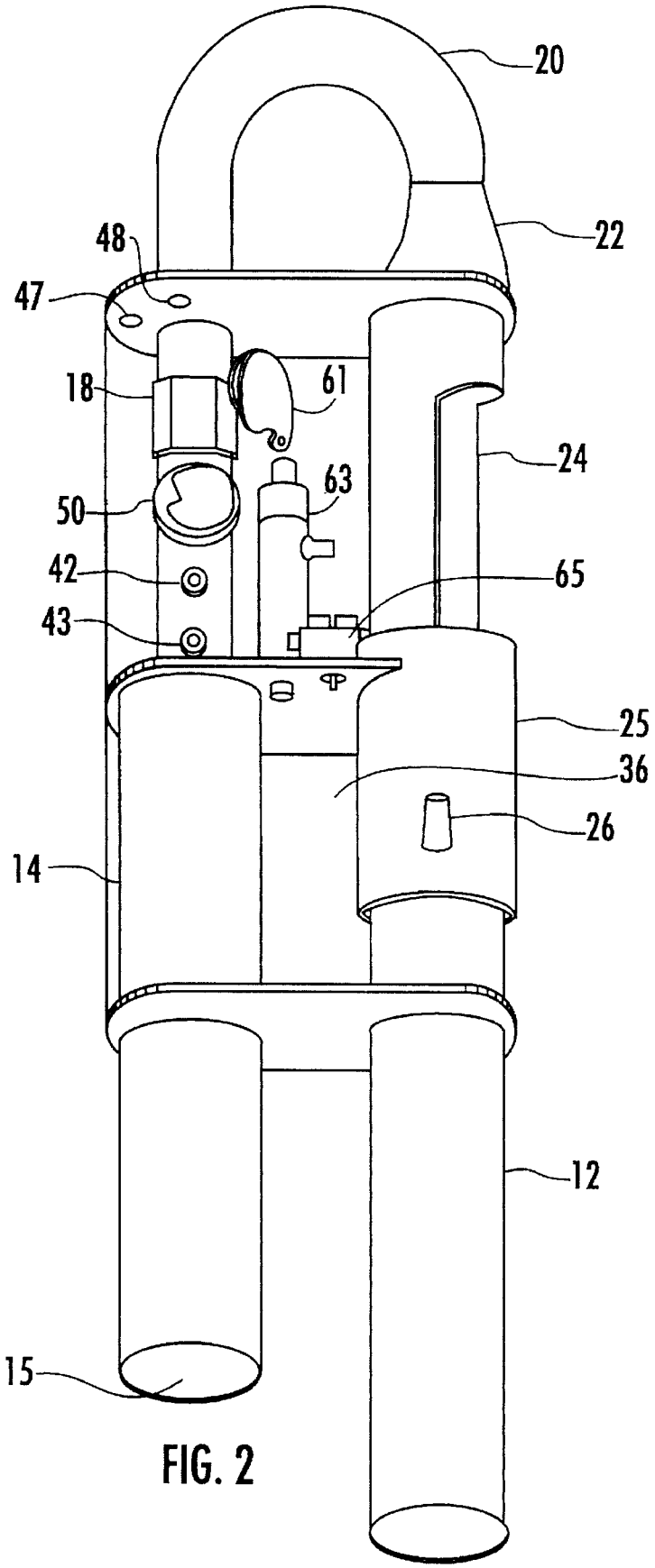
FIG. 2 shows in right view perspective the structural form of the invention with the gauge 50, gas operated ram 63, and the trigger valve in place.
Figure 3:
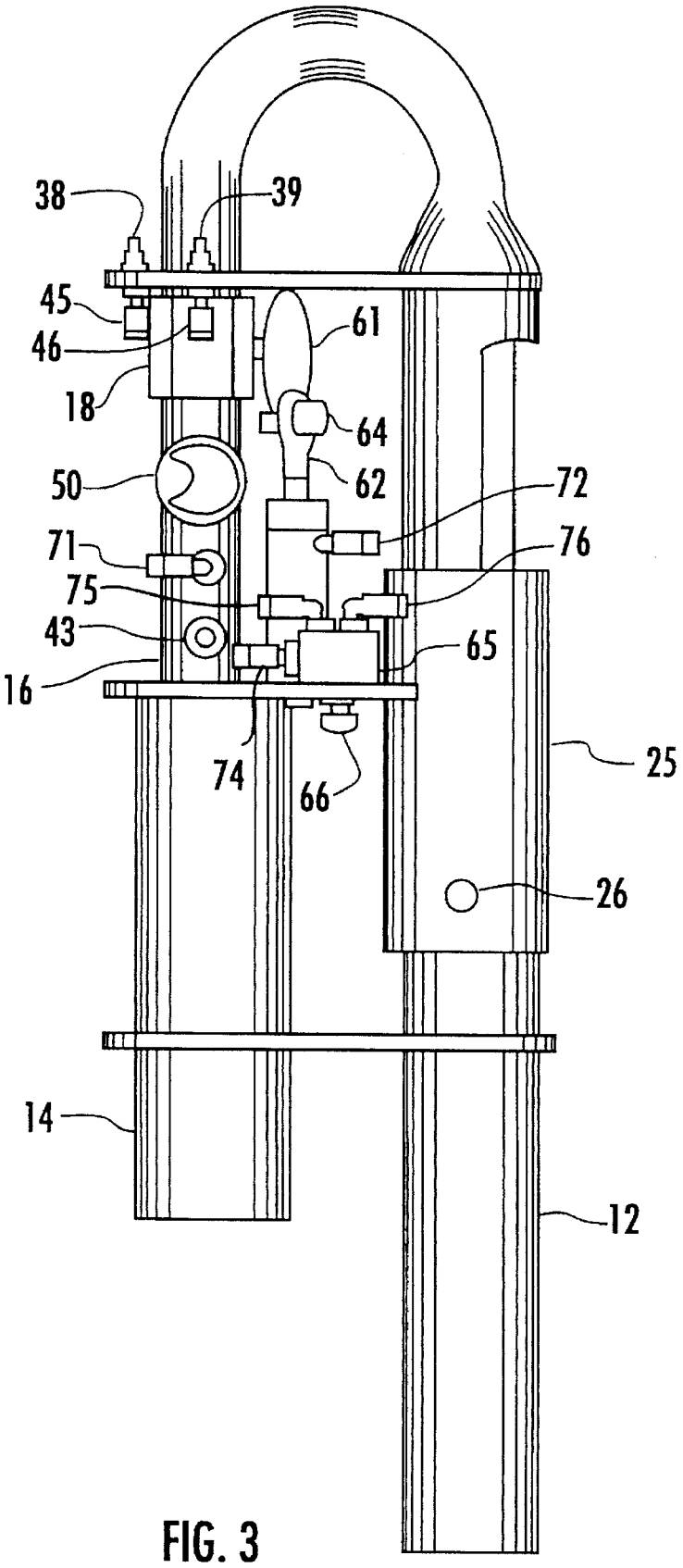
FIG. 3 shows in right side elevation the structural form of the invention with the pneumatic elements included.
Figure 4:
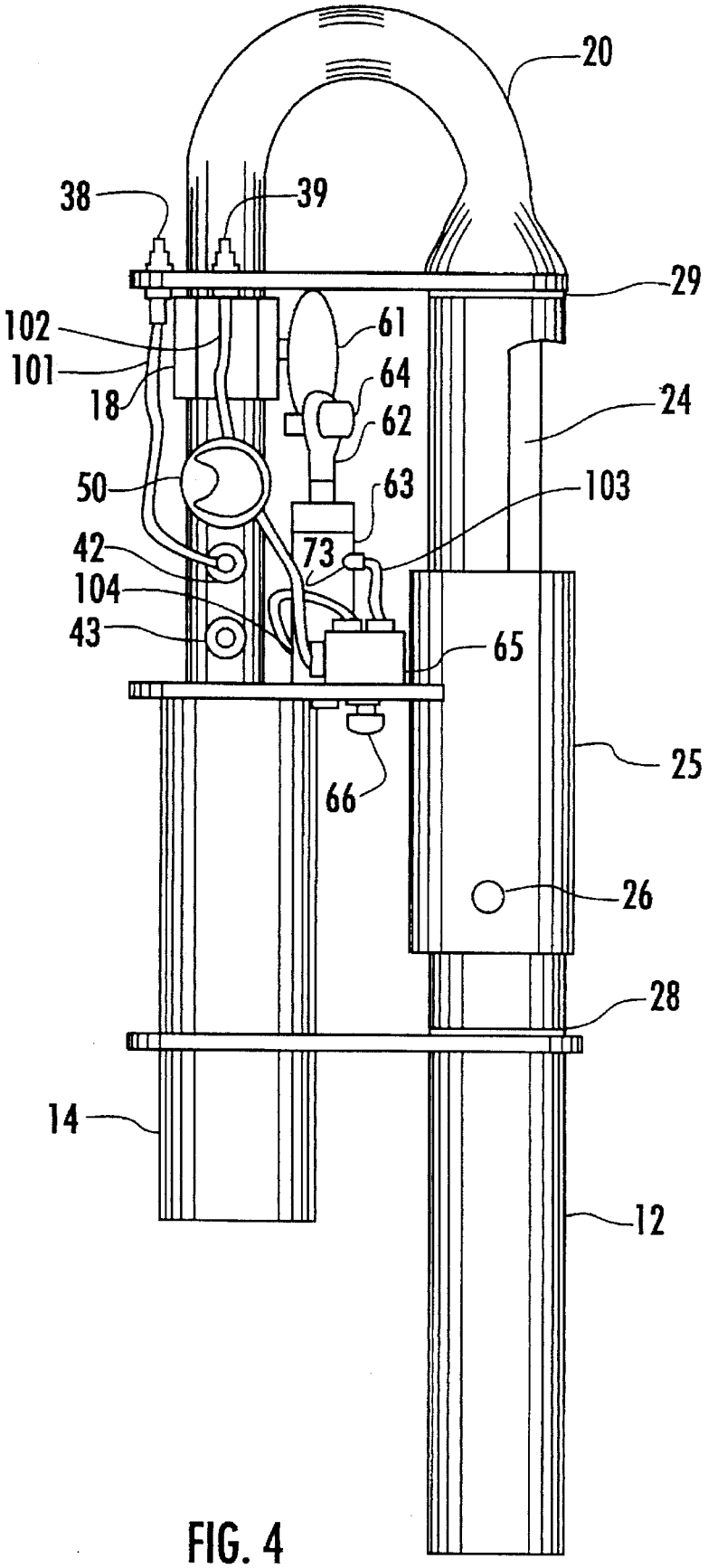
FIG. 4 shows in fight side elevation the structural form of the invention with the pneumatic lines shown as double black lines.

A typical embodiment of the present invention is illustrated in FIGS. 1–5. The structure of the Pneumatic Launcher is fabricated from three plasma cut 14 gauge steel bulkhead plates, the rear bulkhead 30, the central bulkhead 32 and the fore bulkhead 34. These pieces are welded to a 60 inch long piece of 3½"×0.049 wall polished steel tube barrel 12 with a 4"×8" machined breach 24 slot 2 inches from the rear bulkhead 30. A 12 inch aluminum pipe slider 25 of 4" schedule 40 standard wall thickness pipe with a 6 inch long ¾ inch aluminum rod stock handle 26 is welded two inches from the forward end.

A 4½"×0.065 wall tubing accumulator tank 14, 24 inches long with a ¼" thick cap 15 in the forward end is welded in place at the fore bulkhead 34 and at the central bulkhead 32 where it joins the manifold 16. Manifold 16 has two gas supply ports 42 and 43 to pneumatic cylinder. A 1½ inch schedule 40 standard wall thickness pipe section which is welded to the central manifold is threaded with 1½" National Pipe Thread at the other end to accept the 1½" ball valve 18. A small section of 1½" pipe threads into the other end of the valve 18 and passes through the rear bulkhead 30 joining the 180° curved tube 20 and the reducer 22 housing the expansion chamber of FIG. 7 and joining rear bulkhead 30 and the barrel 12.

Figure 7:
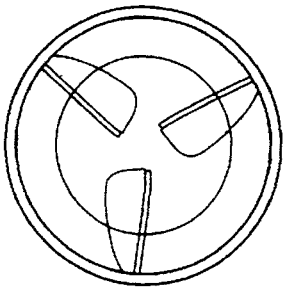
FIGS. 7 and 7A shows a detail in elevation of the expansion chamber; front and side.
Figure 7A:
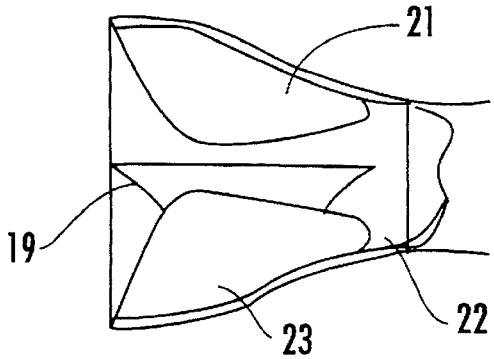

The expansion chamber of FIG. 7 housed in the reducer 22 consists of three vanes 19, 21 and 23 welded to the housing in a slightly tilted attitude such that the gas is caused to spin in a clockwise fashion before entering the barrel 12.

Figure 8:
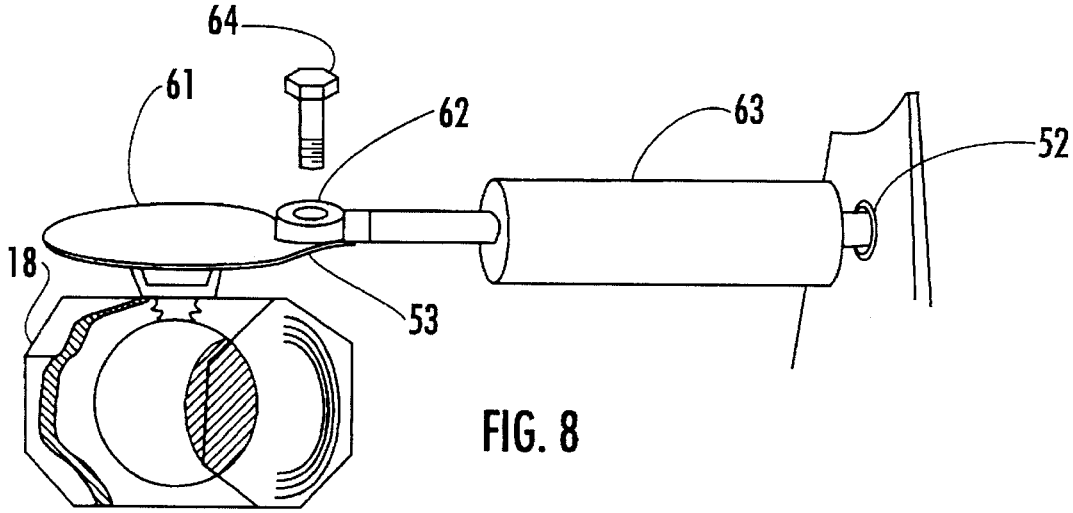
FIG. 8 shows a detail in elevation of the valve actuation mechanism.

The mechanical assemblies of this invention consist of the ball valve 18 which has a cam shaped plate 61 attached to a "T" shaped handle in FIG. 8 bolted to the valve stem. An gas operated 63 includes a ram cylinder 63A which is bolted through a mounting hole 51 in the central bulkhead 32 where it pivots slightly at the mount, and a linear actuator 63B. A rod end hyme joint 62 is threaded to the gas operated ram's rod end and then bolted to the hole 53 in the cam handle plate 61 with a 7/16 bolt 64 with a nylock nut.

The slider 25 is captured between the rear bulkhead 30 and the fore bulkhead 34 where it is allowed to slide forward and backward on the barrel 12, opening and closing the breach 24, and hitting a forward cushion 28 and a rear cushion 29. The handle 26 of the slider is captured in a slot 82 cut in the cover 80 of the unit.

The pneumatic elements of the Pneumatic Launcher consist of the gas operated ram 63 which is double acting and operated by a trigger valve 65 when the button 66 is depressed. The trigger valve 65, which is bolted through mounting hole 52 in the central bulkhead 32, is pressurized through the lower feed opening 74 by a pneumatic line 102 joining a coupling 39 on the rear bulkhead 30 at the mounting coupling 48 with stainless hose fittings 46 and 74, and moves the gas through the "A" port fitting 76 through the gas line 103 to the return port fitting 72 of the gas operated ram 63 to close the valve 18, and through the "B" port fitting 75 through the gas line 104 to the return port fitting 73 of the gas operated ram 63 to open the valve 18 and fire the unit. Gas supply is maintained by male quick connect fittings 38 and 45 to pressurized gas inlet 47 and high pressure pneumatic tubing 101 to return port fitting 71 bolted to gas pressure inlet 42 to accumulator tank.

A 160# Pounds per Square Inch gauge 50 mounted in the rear hole 41 of the manifold 16 monitors the pressure in the accumulator tank 14 and is visible through the opening 83 in the cover 80.

Figure 5:
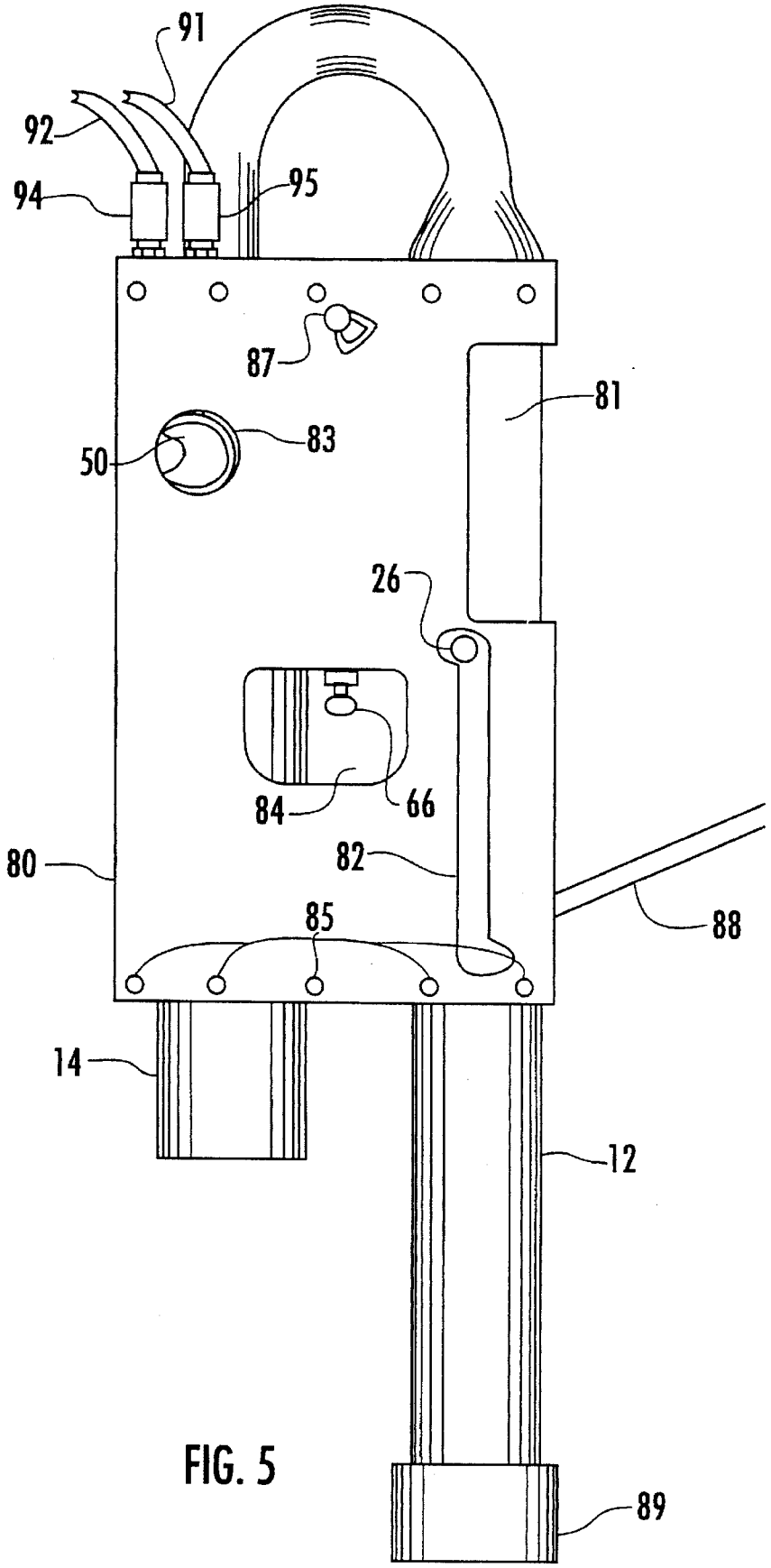
FIG. 5 shows in fight side elevation the structural form of the invention with the outside cover, fittings, mounts and air lines included.
Figure 6:
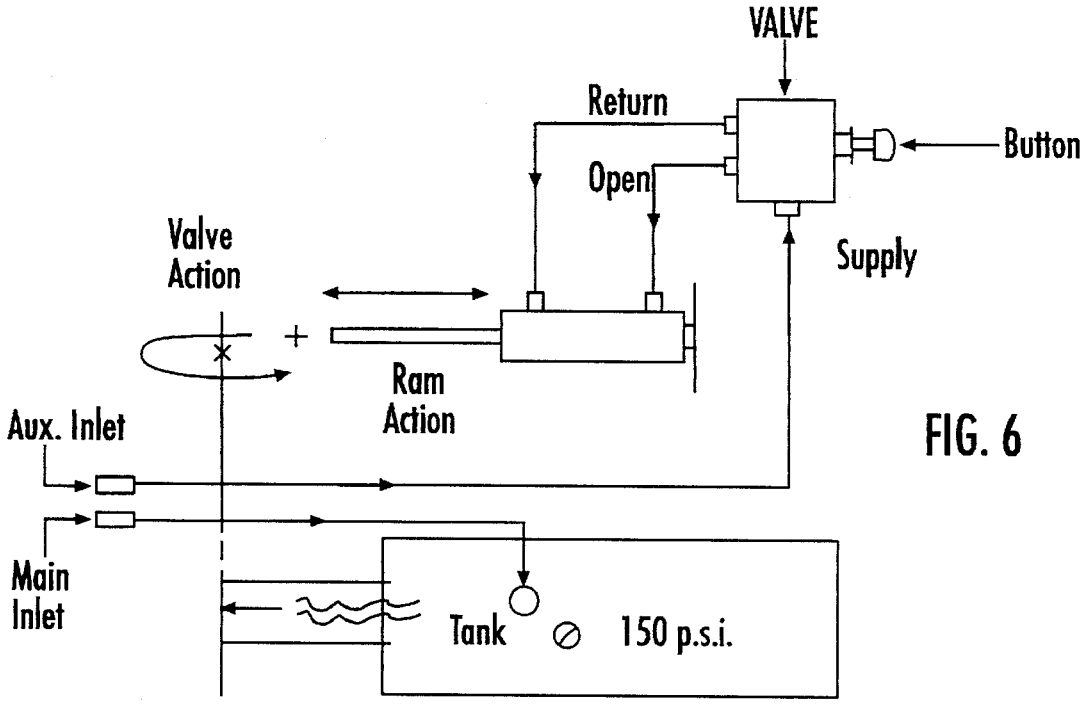
FIG. 6 shows a schematic of the pneumatic systems.

FIG. 5 shows the firing button 66 is accessed through an opening 84 in the cover 80 and works as a comfortable handle. A shoulder strap 88 attached to two swivel mounts 87 supports the unit. A sliding breach cover 81, cover fasteners 85, and a rubber barrel protector 89 are also shown.

The unit is attached to the nitrogen tank and regulator through two gas lines 91 and 92 by quick connect fitting 94 and 95.

I claim:

1. A compressed gas powered launching device for the delivery of items comprising:

a source of compressed gas;

an accumulator tank with an inlet connectable to said source of compressed gas, and an outlet to release gas therefrom;

a barrel which is adapted to receive items to be launched, with an inlet to receive launching gas, and a muzzle through which items are expelled; said accumulator tank and barrel being connected through a gas travel path;

a valve system to allow an operator to control release of gas from the accumulator tank to the barrel, said valve system comprising:

a valve located in said gas travel path between said accumulator tank outlet and said barrel inlet, said valve having a rotary actuator movable between a first rotational position in which gas flow is blocked, and a second rotational position in which gas flow is permitted;

a cam attached to said valve rotary actuator;

a gas operated ram having a ram cylinder located a fixed distance from said valve, and a protruding linear actuator, said ram cylinder including a first port which, when pressurized by gas, causes said actuator to translate to a first linear position, and a second port which, when pressurized by gas, causes said actuator to translate to a second linear position;

said linear actuator connected to said cam such that when said actuator is in said first linear position, said cam is in said first rotational position, blocking gas flow, and when said actuator is in said second linear position, said cam is in said second rotational position, permitting gas flow;

a switch means to allow an operator to control the valve position, said switch means including an inlet connected to a source of compressed gas, and means to direct said compressed gas to either the first port or second port of said ram cylinder to control the position of the linear actuator.

2. The launching device of claim 1, in which the barrel includes a side loading breach for insertion of items to be launched, and means to cover the loading breach.

3. The launching device of claim 1, in which a means to cause rotation of incoming gas is located at the inlet of the barrel, to impart a spin to items as they are launched.

4. The launching device of claim 3, in which an expansion chamber is located at the inlet of the barrel, and the means to cause rotation is a series of vanes in the expansion chamber.

5. The launching device of claim 1, in which the gas travel path between the accumulator tank and barrel includes a tube with a 180° bend, so that the accumulator tank and barrel are side by side.

6. The launching device of claim 5, in which at least one bulkhead is connected between the accumulator tank and barrel.

7. The launching device of claim 6, in which said ram cylinder is attached to said at least one bulkhead, with a pivotal connection.

8. The launching device of claim 1, in which said valve is a ball valve.

9. The launcher of claim 1, in which said switch means includes a button to be pushed by an operator.

10. The launcher of claim 1 in which said accumulator tank and said switch means share the same source of compressed gas.

* * * * *